US011440760B2

(12) United States Patent
Nagasaki

(10) Patent No.: US 11,440,760 B2
(45) Date of Patent: Sep. 13, 2022

(54) SHEET CONVEYANCE APPARATUS AND IMAGE FORMING APPARATUS

(71) Applicant: CANON KABUSHIKI KAISHA, Tokyo (JP)

(72) Inventor: Tsuyoshi Nagasaki, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 181 days.

(21) Appl. No.: 16/750,042

(22) Filed: Jan. 23, 2020

(65) Prior Publication Data

US 2020/0255242 A1 Aug. 13, 2020

(30) Foreign Application Priority Data

Feb. 8, 2019 (JP) ..... JP2019-021749

(51) Int. Cl.

| | |
|---|---|
| ***B65H 9/00*** | (2006.01) |
| ***B65H 29/12*** | (2006.01) |
| ***B65H 9/20*** | (2006.01) |
| ***B65H 9/06*** | (2006.01) |

(52) U.S. Cl.

CPC ..... *B65H 9/004* (2013.01); *B65H 9/06* (2013.01); *B65H 9/20* (2013.01); *B65H 29/125* (2013.01)

(58) Field of Classification Search

CPC ..... B65H 9/004; B65H 9/006; B65H 9/20; B65H 2301/4423

See application file for complete search history.

(56) References Cited

U.S. PATENT DOCUMENTS

| | | | | |
|---|---|---|---|---|
| 4,842,944 | A * | 6/1989 | Kuge | B65H 27/00 219/216 |
| 8,387,975 | B2 * | 3/2013 | Suzuki | B65H 7/02 271/243 |
| 9,388,005 | B2 * | 7/2016 | Iizuka | B65H 9/004 |
| 9,586,778 | B2 | 3/2017 | Iizuka | |
| 9,938,102 | B2 | 4/2018 | Iizuka | |
| 2018/0186588 | A1 | 7/2018 | Iizuka | |

FOREIGN PATENT DOCUMENTS

| | | |
|---|---|---|
| JP | H11-255378 A | 9/1999 |
| JP | 2013-177244 A | 9/2013 |

* cited by examiner

*Primary Examiner* — Howard J Sanders
(74) *Attorney, Agent, or Firm* — Venable LLP

(57) ABSTRACT

A sheet conveyance apparatus includes first and second abutment surfaces in contact a leading edge of a conveyed sheet before the sheet is nipped by a conveyance portion, which nips the sheet while the first and second abutment members are moving from respective standby positions together with first and second rotary members by being pressed by the leading edge. The first and second rotary members are in contact with the sheet being conveyed by the second conveyance portion after the leading edge of the sheet passes through the first abutment surface, the first rotary member, and the second abutment surface, and the second rotary member, and the first and second abutment members move toward standby positions by urging members after a trailing edge of the sheet passing through the first and second rotary members.

17 Claims, 6 Drawing Sheets

SHEET CONVEYANCE APPARATUS AND IMAGE FORMING APPARATUS

BACKGROUND OF THE INVENTION

Field of the Invention

The present invention relates to a sheet conveyance apparatus for conveying sheets and an image forming apparatus equipped with the same.

Description of the Related Art

Generally, an image forming apparatus such as a printer that is equipped with a skew correction unit provided upstream of an image forming position in a sheet conveyance direction to correct skewing of the sheet for improving image quality is known.

Hitherto, a skew correction unit including an engagement member having an abutment surface against which a leading edge of a sheet abuts, and a retention member that retains the engagement member and pivots integrally with the engagement member by the abutment surface being pushed by the sheet is proposed (refer to Japanese Patent Application Laid-Open Publication No. 2013-177244). After the retention member pivots integrally with the engagement member, when a leading edge of the sheet passes the abutment surface, the retention member returns to a standby position and the engagement member pivots relatively with respect to the retention member, and the engagement member slides against a surface of the sheet. Then, after a trailing edge of the sheet passes the engagement member, the engagement member returns to the standby position. As described, by configuring the skew correction unit with two members, an engagement member and a retention member, it becomes possible to reduce the amount of pivoting of the engagement member after the trailing edge of the sheet has passed the engagement member and to improve throughput.

Recently, there are increasing demands for printing labels, related, for example, to printing addresses and names on labels and adhering them on post cards to send direct mails, or to printing names, usage instructions and effects of medicine on labels in pharmacies. Such adhesive label sheets are integrated sheet materials, each composed of a label having an adhesive applied on one side and an adhesive release paper which is attached to an adhesive side of the label, having a drawback in that the adhesive may be exposed at an edge in which the label and the adhesive release paper are attached.

Therefore, in a state where the adhesive label sheet is conveyed to the skew correction unit disclosed in Japanese Patent Application Laid-Open Publication No. 2013-177244, there may be a case where the adhesive of the adhesive label sheet is adhered to an abutment surface of the engagement member. The adhesive adhered to the abutment surface is spread by a subsequent sheet and the like, especially at a portion of the engagement member that slides against the surface of the sheet, and causes the sheet to be adhered to the adhesive spread on the sliding surface portion, which may lead to conveyance failure such as jamming of sheets or damages such as bending of the sheet.

SUMMARY OF THE INVENTION

According to a first aspect of the present invention, a sheet conveyance apparatus includes a first conveyance portion configured to convey a sheet, an abutment member including an abutment surface against which a leading edge of the sheet conveyed by the first conveyance portion abuts, the abutment member configured to move from a standby position by the abutment surface being pressed by the sheet, a second conveyance portion configured to nip the sheet during a process in which the abutment member moves from the standby position and to convey the sheet being nipped, an urging member configured to urge the abutment member toward the standby position, and a rotary member supported rotatably on the abutment member, wherein the rotary member is in contact with the sheet being conveyed by the second conveyance portion, and the abutment member is separated from the sheet in a state where the rotary member is in contact with the sheet being conveyed by the second conveyance portion after the leading edge of the sheet being conveyed passes the abutment surface.

According to a second aspect of the present invention, a sheet conveyance apparatus includes a first roller pair configured to convey a sheet, an abutment member including an abutment surface against which a leading edge of the sheet conveyed by the first roller pair abuts, the abutment member configured to move from a standby position by the abutment surface being pressed by the sheet, a second roller pair configured to nip the sheet during a process in which the abutment member moves from the standby position and to convey the sheet being nipped, an urging member configured to urge the abutment member toward the standby position, and a rotary member supported rotatably on the abutment member, wherein the rotary member is in contact with the sheet being conveyed by the second roller pair, and the abutment member is positioned at a position where the abutment member does not intersect with a nip line of the second roller pair in a state where the rotary member is in contact with the sheet being conveyed by the second roller pair after the leading edge of the sheet being conveyed passes the abutment surface.

Further features of the present invention will become apparent from the following description of exemplary embodiments with reference to the attached drawings.

DESCRIPTION OF THE EMBODIMENTS

First Embodiment

General Arrangement

Figure 1:
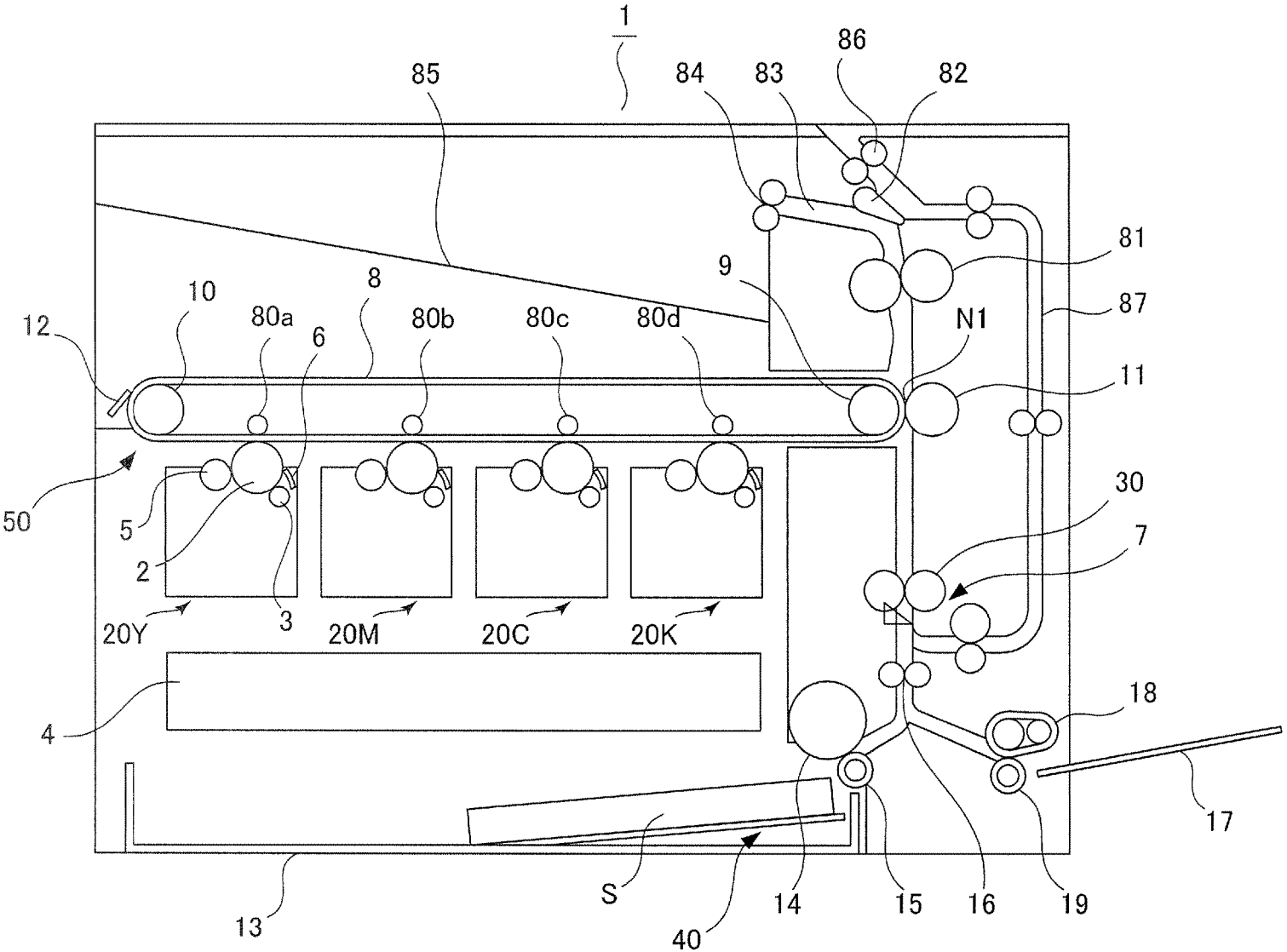
FIG. 1 is a general schematic view illustrating a printer according to a first embodiment.

At first, a first embodiment of a present invention will be described. A printer 1 serving as an image forming apparatus according to a first embodiment is a laser beam printer adopting an electrophotographic system. The printer 1 includes, as illustrated in FIG. 1, an image forming unit 50 forming an image on a sheet S, a sheet feed unit 40, a sheet conveyance apparatus 7, a fixing unit 81, a sheet discharge roller pair 84, and an inversion roller pair 86. The image forming unit 50 includes four process cartridges 20Y, 20M, 20C and 20K, respectively forming toner images of four colors, which are yellow (Y), magenta (M), cyan (C) and black (K), and a scanner unit 4.

The four process cartridges 20Y, 20M, 20C and 20K adopt a same configuration, except for the difference in the colors of the images being formed. Therefore, the configuration and image forming process of only the process cartridge 20Y will be described, and descriptions of process cartridges 20M, 20C and 20K will be omitted.

The process cartridge 20Y includes a photosensitive drum 2, a charge roller 3, a developing roller 5, and a cleaning blade 6. The photosensitive drum 2 is formed by coating an organic photoconductive layer on an outer circumference of an aluminum cylinder, and the photosensitive drum 2 is rotated by a drive motor not shown. Further, the image forming unit 50 includes an intermediate transfer belt 8 wound around a drive roller 9 and a tension roller 10, and primary transfer rollers 80*a*, 80*b*, 80*c* and 80*d* are provided on an inner side of the intermediate transfer belt 8. Further, a secondary transfer roller 11 is arranged to oppose to the drive roller 9 with the intermediate transfer belt 8 interposed therebetween, and the intermediate transfer belt 8 together with the secondary transfer roller 11 form a transfer nip N1 where image is transferred to the sheet S being conveyed.

The sheet feed unit 40 is provided at a lower portion of the printer 1, and includes a cassette 13 that supports sheets S, a pickup roller 14 that feeds sheets S supported on the cassette 13, and a separation roller 15. The sheet conveyance apparatus 7 includes a registration roller pair 30. The fixing unit 81 includes a fixing roller and a pressure roller that apply heat and pressure to the sheet.

Next, an image forming operation of the printer 1 configured as above will be described. If an image signal is entered to the scanner unit 4 from a personal computer and the like not shown, a laser beam corresponding to the image signal is irradiated from the scanner unit 4 to the photosensitive drum 2 of the process cartridge 20Y.

In this state, the surface of the photosensitive drum 2 is charged uniformly in advance to a predetermined polarity and potential by the charge roller 3, and by having a laser beam irradiated from the scanner unit 4, an electrostatic latent image is formed on the surface of the photosensitive drum 2. The electrostatic latent image formed on the photosensitive drum 2 is developed by the developing roller 5, and a yellow (Y) toner image is formed on the photosensitive drum 2.

Similarly, a laser beam is irradiated from the scanner unit 4 to the respective photosensitive drums of the process cartridges 20M, 20C and 20K, and toner images of magenta (M), cyan (C) and black (K) are formed on the respective photosensitive drums. Toner images of respective colors formed on the respective photosensitive drums are transferred from the primary transfer rollers 80*a*, 80*b*, 80*c* and 80*d* to the intermediate transfer belt 8, and the images are transferred to the transfer nip N1 on the intermediate transfer belt 8 rotated by the drive roller 9. The image forming process of each color is performed at such a timing that the toner image is superposed to a primarily transferred toner image formed upstream on the intermediate transfer belt 8. The toner remaining on the photosensitive drum 2 after the toner image has been transferred by the primary transfer roller 80*a* is collected by the cleaning blade 6.

In parallel with the image forming process, the sheet S stored in the cassette 13 of the sheet feed unit 40 is sent out by the pickup roller 14 and separated one sheet at a time by the separation roller 15. Skewing of the sheet S is corrected by a skew correction unit of the sheet conveyance apparatus 7 described later, and the sheet S is conveyed by a registration roller pair 30 at a predetermined conveyance timing in correspondence with a transfer timing of image at the transfer nip N1. The printer 1 includes a manual sheet feed tray 17 on which the sheet S is placed, and the sheet S placed on the manual sheet feed tray 17 may be fed by a manual sheet feed belt 18 and a separation roller 19.

Thereafter, a full-color toner image on the intermediate transfer belt 8 is transferred at the transfer nip N1 to the sheet S by secondary transfer bias applied to the secondary transfer roller 11. The toner remaining on the intermediate transfer belt 8 is cleaned by a cleaning device 12. Predetermined heat and pressure are applied at the fixing unit 81 to the sheet S on which the toner image has been transferred, and the toner is melted and fixed. The sheet S having passed the fixing unit 81 is guided by a guide member 82 to the sheet discharge roller pair 84 and discharged by the sheet discharge roller pair 84 to a sheet discharge tray 85.

If a duplex printing job of forming images on both sides of the sheet S is entered, the sheet S on which an image has been formed on the surface at the transfer nip N1 is guided by the guide member 82 to the inversion roller pair 86. Then, the sheet S is inverted by the inversion roller pair 86 and conveyed to a duplex conveyance path 87. The sheet S guided to the duplex conveyance path 87 is conveyed again to the sheet conveyance apparatus 7, where image is formed on a rear side of the sheet at the transfer nip N1, and the sheet is discharged by the sheet discharge roller pair 84 onto the sheet discharge tray 85.

Sheet Conveyance Apparatus

Figure 2:
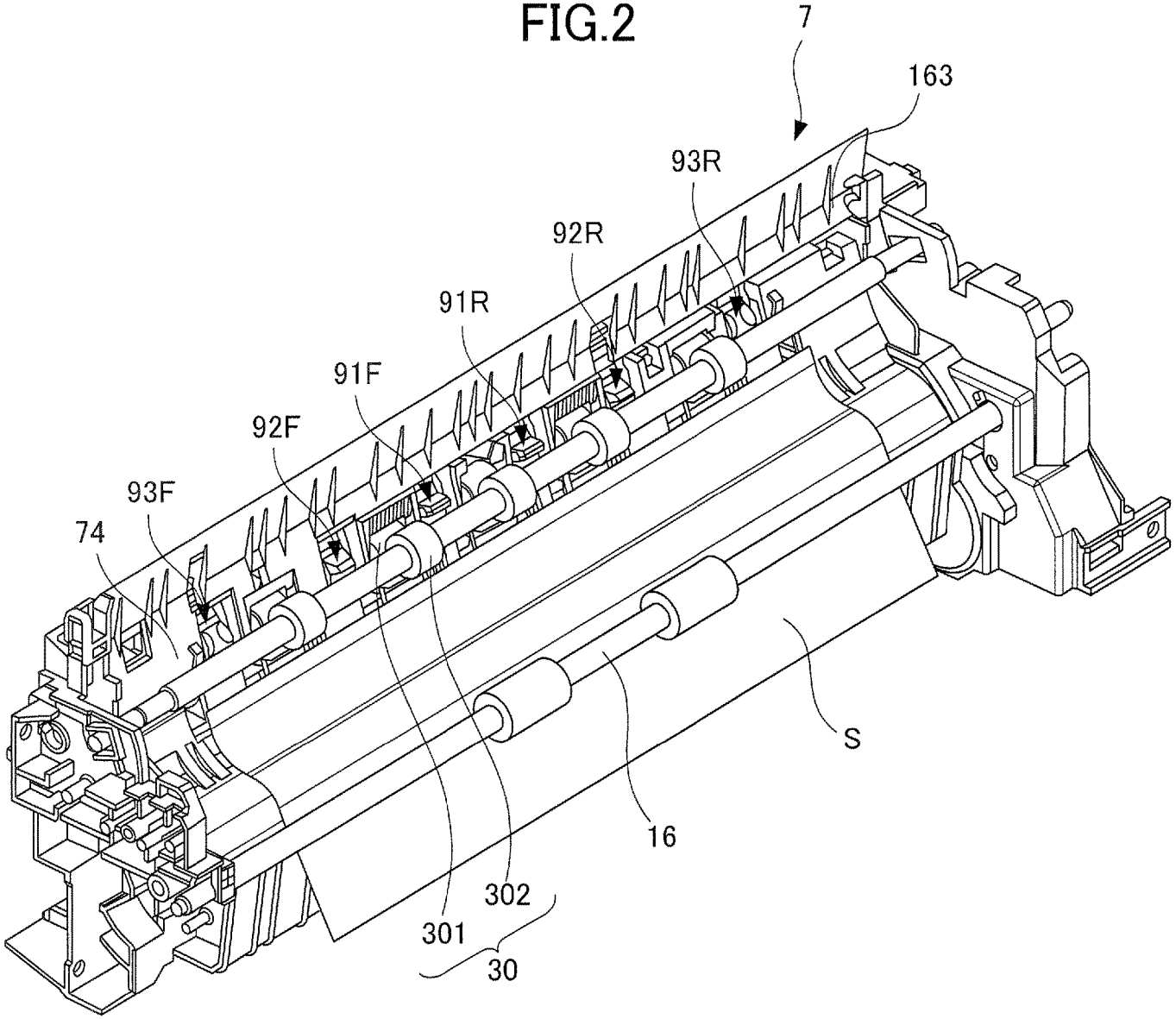
FIG. 2 is a perspective view illustrating a sheet conveyance apparatus.

Next, the configuration of the sheet conveyance apparatus 7 will be described with reference to FIGS. 2 to 4. The sheet conveyance apparatus 7 includes a pre-registration roller pair 16, the registration roller pair 30, and six skew correction units 91F, 91R, 92F, 92R, 93F and 93R.

Figure 4:
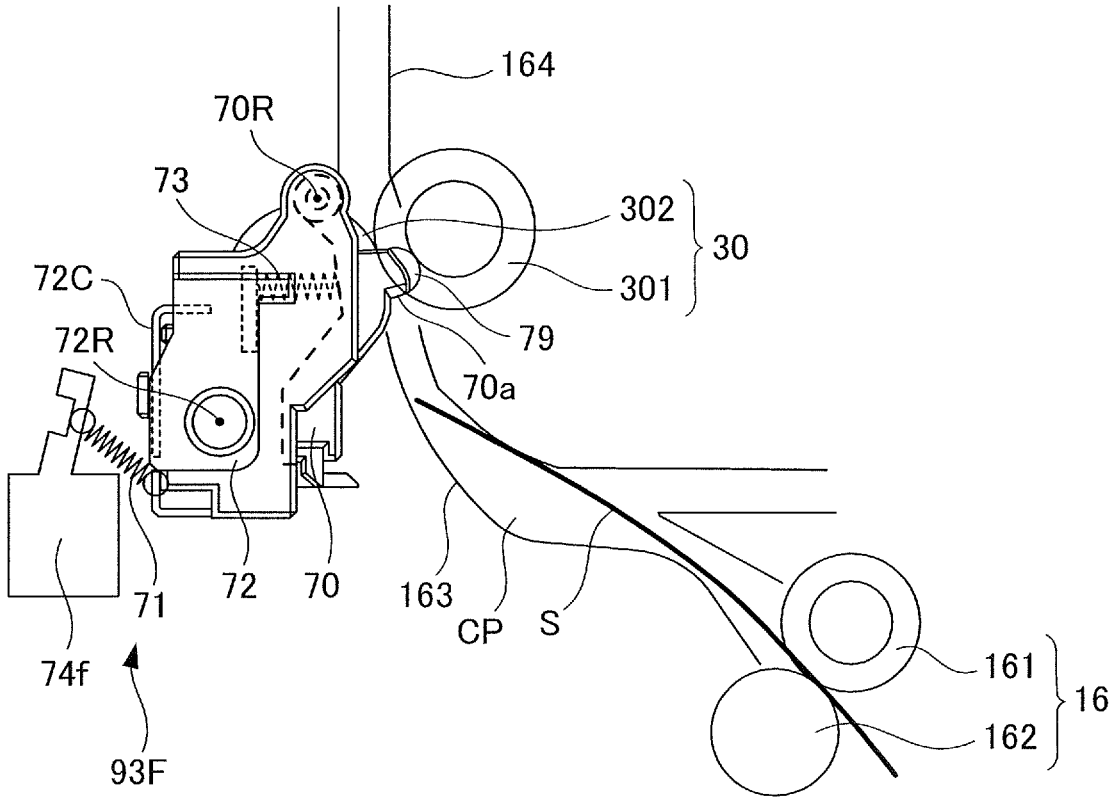
FIG. 4 is a side view illustrating a skew correction unit.

As illustrated in FIG. 4, the pre-registration roller pair 16 serving as a first conveyance portion and a first roller pair includes a drive roller 161, and a driven roller 162 driven to rotate by the drive roller 161. The sheet conveyed by the pre-registration roller pair 16 is guided by a pair of conveyance guides 163 and 164 forming a conveyance path CP. The registration roller pair 30 serving as a second conveyance portion and a second roller pair includes a drive roller 301 serving as a first roller driven by a drive motor not shown, and a driven roller 302 serving as a second roller that rotates by being driven by the drive roller 301.

Figure 3:
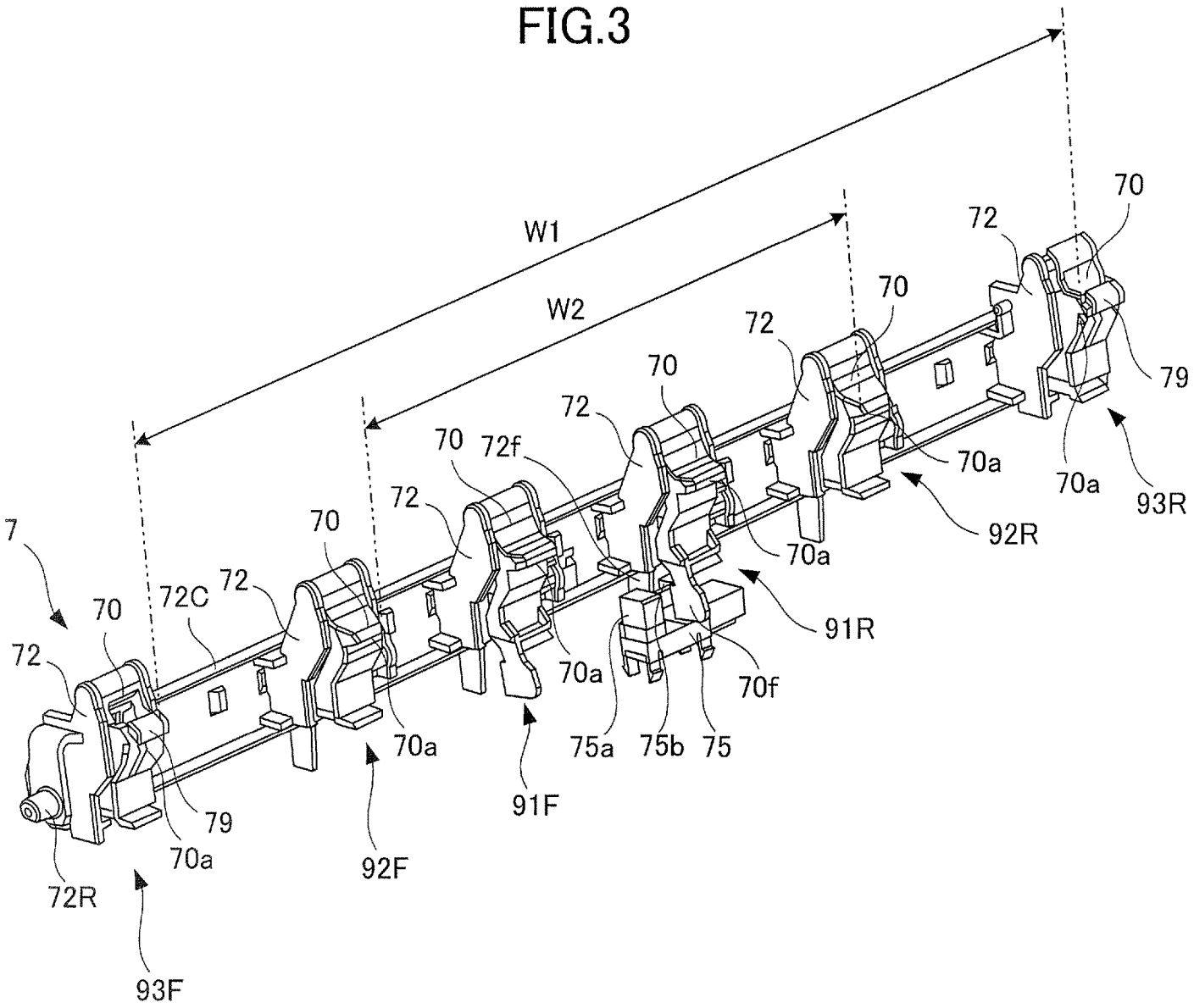
FIG. 3 is a perspective view illustrating respective skew correction units of the sheet conveyance apparatus.

As illustrated in FIG. 3, six skew correction units 91F, 91R, 92F, 92R, 93F and 93R are connected by a connecting plate 72C, and each skew correction unit includes a retention member 72 retained on the connecting plate 72C and a shutter member 70 pivotably supported on the retention member 72. The connecting plate 72C is supported pivotably around a pivot shaft 72R. That is, the respective retention members 72 supported on the connecting plate 72C pivot around the pivot shaft 72R serving as a second pivot shaft. As described, the retention member 72 is supported movably between a first position (refer to FIG. 5A) and a second position (refer to FIG. 5B) around the pivot shaft 72R.

As illustrated in FIG. 4, the respective retention members 72 support the shutter member 70 pivotably around a pivot shaft 70R that differs from the pivot shaft 72R, and the shutter member 70 includes an abutment surface 70*a* that abuts against the leading edge of the sheet S conveyed by the pre-registration roller pair 16. The shutter member 70 serving as an abutment member is relatively pivotably supported between a standby position (refer to FIG. 5A) and a retreated position (refer to FIG. 5C) with respect to the retention member 72. The standby position and the retreated position are relative positions with respect to the retention member 72.

A first urging spring 73 serving as an urging member and first urging member is provided in a contracted state between the shutter member 70 and the retention member 72, and the shutter member 70 is urged toward a standby position illustrated in FIG. 4. At the standby position, the shutter member 70 is abutted against and positioned with respect to the retention member 72, and in a state where the abutment surface 70*a* is pressed by the leading edge of the sheet S, the shutter member 70 pivots around the pivot shaft 72R integrally with the retention member 72. The abutment surface 70*a* of the shutter member 70 positioned at the standby position is arranged to protrude to the conveyance path CP from the conveyance guide 163, as illustrated in FIGS. 2 and 4.

Further, a second urging spring 71 serving as a second urging member is extended between the retention member 72 and a spring hook 74*f* of a sheet feed frame 74 (refer to FIG. 2), and the retention member 72 is urged toward a first position illustrated in FIG. 4. In a state where the retention member 72 is positioned at the first position, the connecting plate 72C is positioned by being abutted against a stopper not shown. In other words, in FIG. 4, a skew correction unit 93F including the shutter member 70 and the retention member 72 is positioned in a first state in which a leading edge of the sheet S conveyed by the pre-registration roller pair 16 is capable of abutting against the abutment surface 70*a*.

As illustrated in FIG. 3, the six skew correction units 91F, 91R, 92F, 92R, 93F and 93R are arranged in parallel in a width direction orthogonal to the sheet conveyance direction, and they are arranged symmetrically from a center in the width direction of the conveyance path CP set as reference. The abutment surfaces 70*a* of the respective skew correction units are arranged so that the abutment surfaces 70*a* of the skew correction units positioned closer to the center in the width direction are arranged more downstream in the sheet conveyance direction. The abutment surfaces 70*a* of the skew correction units 91F and 91R that are arranged at innermost areas in the width direction are arranged more downstream in the sheet conveyance direction than the abutment surfaces 70*a* of the skew correction units 92F and 92R arranged on the outer sides thereof. Further, the abutment surfaces 70*a* of the skew correction units 92F and 92R are arranged more downstream in the sheet conveyance direction than the abutment surfaces 70*a* of the skew correction units 93F and 93R arranged on the outermost sides in the width direction.

Now, a distance between abutment surfaces 70*a* and 70*a* of the skew correction units 93F and 93R in the width direction is set as distance W1, and a distance between abutment surfaces 70*a* and 70*a* of the skew correction units 92F and 92R in the width direction is set as distance W2. If a sheet having a width wider than distance W1 is conveyed, the sheet contacts the abutment surfaces 70*a* and 70*a* of the skew correction units 93F and 93R before coming into contact with the skew correction units 91F, 91R, 92F and 92R, and skewing is corrected.

If a sheet having a width narrower than distance W1 and wider than distance W2 is conveyed, the sheet contacts the abutment surfaces 70*a* and 70*a* of the skew correction units 92F and 92R before coming into contact with the skew correction units 91F and 91R, and skewing is corrected. If a sheet having a width narrower than distance W2 is conveyed, the sheet contacts the abutment surfaces 70*a* and 70*a* of the skew correction units 91F and 91R without coming into contact with the skew correction units 92F, 92R, 93F and 93R, and skewing is corrected.

By arranging the skew correction units 91F, 91R, 92F, 92R, 93F and 93R as described, the leading edge of the sheet abuts against two abutment surfaces 70*a* and 70*a* that are as spaced apart in the width direction as possible corresponding to the size of the sheet being conveyed. Thereby, skewing of the sheet can be corrected highly accurately.

A photosensor 75 serving as a detection sensor is arranged at a position corresponding to the skew correction unit 91R arranged at the center side in the width direction. The photosensor 75 includes a light emitting unit 75*a* having a light source and a light receiving unit 75*b* capable of receiving light emitted from the light emitting unit 75*a*. The photosensor 75 outputs different signals depending on whether an optical path between the light emitting unit 75*a* and the light receiving unit 75*b* is opened or blocked.

A first flag 70*f* serving as a flag portion is provided at a lower portion of the shutter member 70 of the skew correction unit 91R, and a second flag 72*f* is provided at a lower portion of the retention member 72. The first flag 70*f* and the second flag 72*f* are configured to open and block the optical path of the photosensor 75 based on the pivoting positions of the shutter member 70 and the retention member 72. In other words, the position of the sheet being conveyed can be detected by a signal output from the photosensor 75 based on the operation of the first flag 70*f* and the second flag 72*f*.

In the present embodiment, the skew correction units 91F, 91R, 92F and 92R excluding the outermost skew correction units 93F and 93R adopt a same configuration. The only difference between the skew correction units 93F and 93R and the skew correction units 91F, 91R, 92F and 92R is that in the former units, a driven roller 79 is provided on the shutter member 70. The skew correction units 93F and 93R adopt a same configuration.

Generally, an adhesive label sheet in which a label having an adhesive applied on one side and an adhesive release paper attached to the adhesive side of the label are integrated have a standard size, and the adhesive label sheet serving as the sheet member used in the printer 1 according to the present embodiment has a width wider than distance W1. Therefore, skewing of the adhesive label sheet is corrected by the skew correction units 93F and 93R. In the process during which the adhesive label sheet passes the skew correction units 93F and 93R, as described later, the retention member 72 of the skew correction units 93F and 93R pivot. When the retention member 72 of the skew correction units 93F and 93R pivots, the retention member 72 of the skew correction unit 91R having the second flag 72*f* co-rotates with the connecting plate 72C. Further, the shutter member 70 of the skew correction unit 91R having the first flag 70*f* also pivots by being pushed by the adhesive label sheet being conveyed. Therefore, even according to an adhesive label sheet having a width wider than distance W1, the position of the adhesive label sheet can be detected by the photosensor 75.

As illustrated in FIG. 4, the shutter member 70 of the skew correction unit 93F arranged on the outermost side in the width direction is arranged on a first side with respect to the conveyance path CP, i.e., left side in the drawing, and rotatably supports the driven roller 79 serving as a rotary member. The driven roller 79 is arranged downstream in the sheet conveyance direction of the abutment surface 70*a*, and at least a portion of the outer circumference surface is protruded to a second side with respect to the conveyance path CP, i.e., right side in the drawing, than the abutment surface 70*a*. In further detail, in a state where the skew correction unit 93F is at the first state, as described later, the driven roller 79 is arranged more downstream than the abutment surface 70*a* in the sheet conveyance direction. In a state where the shutter member 70 is positioned at the standby position, the abutment surface 70*a* of the shutter member 70 is arranged more upstream in the sheet conveyance direction than a nip N2 (refer to FIG. 5B) of the registration roller pair 30. Since the driven roller 79 is arranged in this manner, the driven roller 79 is configured slidably with respect to the sheet such as the adhesive label sheet when the shutter member 70 is positioned at the retreated position.

Operation of Skew Correction Unit

Figure 5A:
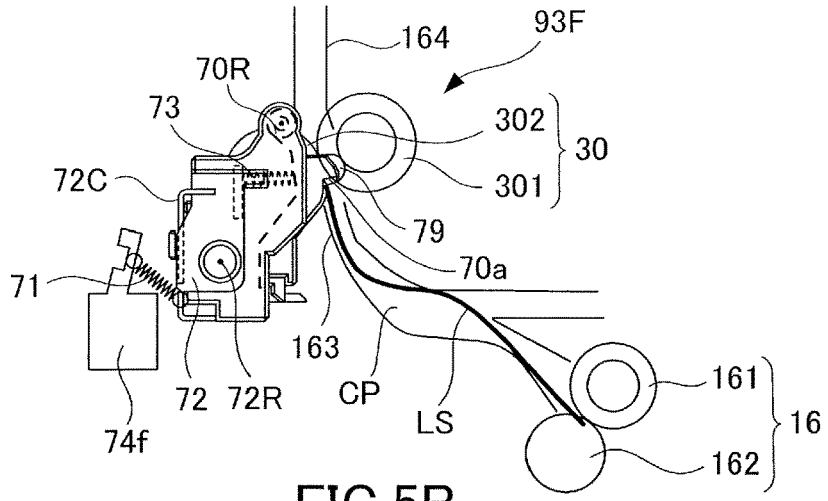
FIG. 5A is a side view illustrating a state in which a leading edge of an adhesive label sheet is abutted against an abutment surface of a skew correction unit in a first state.
Figure 5B:
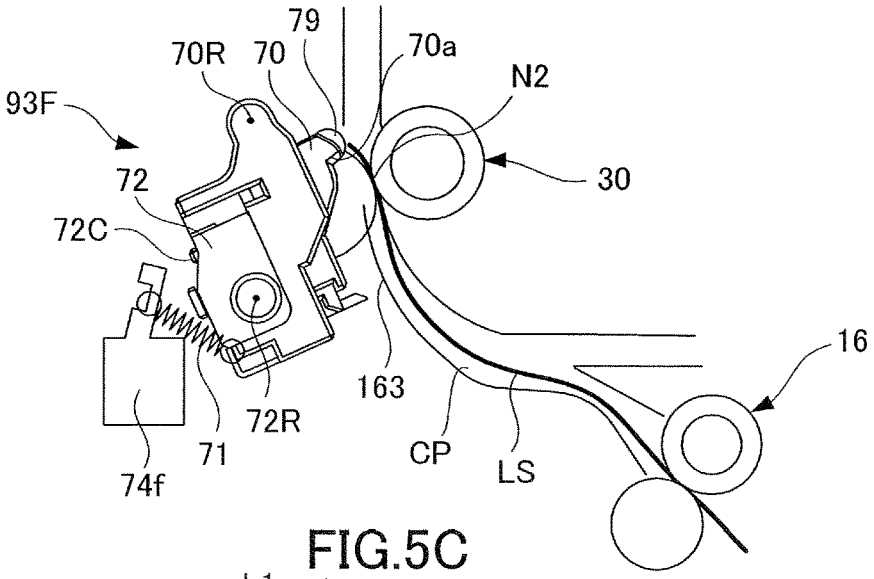
FIG. 5B is a side view illustrating a state in which a skew correction unit is pressed by the adhesive label sheet and has transited to a second state.

Next, the operation of the skew correction unit 93F in a state where an adhesive label sheet LS is conveyed will be described with reference to FIGS. 5A to 5C. In FIG. 5A, similar to FIG. 4, the skew correction unit 93F is at a first state where the shutter member 70 is positioned at the standby position and the retention member 72 is positioned at the first position. In this state, the first flag 70*f* and the second flag 72*f* are arranged at a position opening an optical axis, i.e., optical path, of the photosensor 75 (refer to FIG. 3).

In a state where a leading edge of the adhesive label sheet LS abuts against the abutment surface 70*a*, a loop is formed on the adhesive label sheet LS, and skewing of the adhesive label sheet LS is corrected by the leading edge of the sheet being aligned on the abutment surface 70*a* of the skew correction unit 93F and the abutment surface 70*a* of the skew correction unit 93R. Further, in a state where the adhesive label sheet LS is conveyed by the pre-registration roller pair 16, as illustrated in FIG. 5B, the adhesive label sheet LS causes the shutter member 70 and the retention member 72 to pivot around the pivot shaft 72R against the urging force of the second urging spring 71.

During the process in which the shutter member 70 and the retention member 72 pivot integrally, the abutment surface 70*a* of the shutter member 70 retreats from the conveyance path CP, and the nip N2 of the registration roller pair 30 nips and conveys the adhesive label sheet LS. That is, during the process in which the shutter member 70 moves from the standby position, the nip N2 of the registration roller pair 30 nips the adhesive label sheet LS and conveys the adhesive label sheet LS being nipped. In this state, the skew correction unit 93F is at a second state where the retention member 72 is positioned at the second position and the shutter member 70 is positioned at the standby position, with the leading edge of the adhesive label sheet LS separated from the abutment surface 70*a*. While the skew correction unit 93F transits from the first state to the second state, the second flag 72*f* of the retention member 72 blocks the optical axis of the photosensor 75. Thereby, the photosensor 75 can detect the leading edge position of the sheet S.

The leading edge of the adhesive label sheet LS moves in sliding motion from the abutment surface 70*a* toward the driven roller 79, and the adhesive label sheet LS is conveyed in sliding motion against the driven roller 79. As described, in a state where the leading edge of the adhesive label sheet LS slides against the abutment surface 70*a*, the adhesive provided between the label and the adhesive release paper of the adhesive label sheet LS may adhere to the abutment surface 70*a*.

Figure 5C:
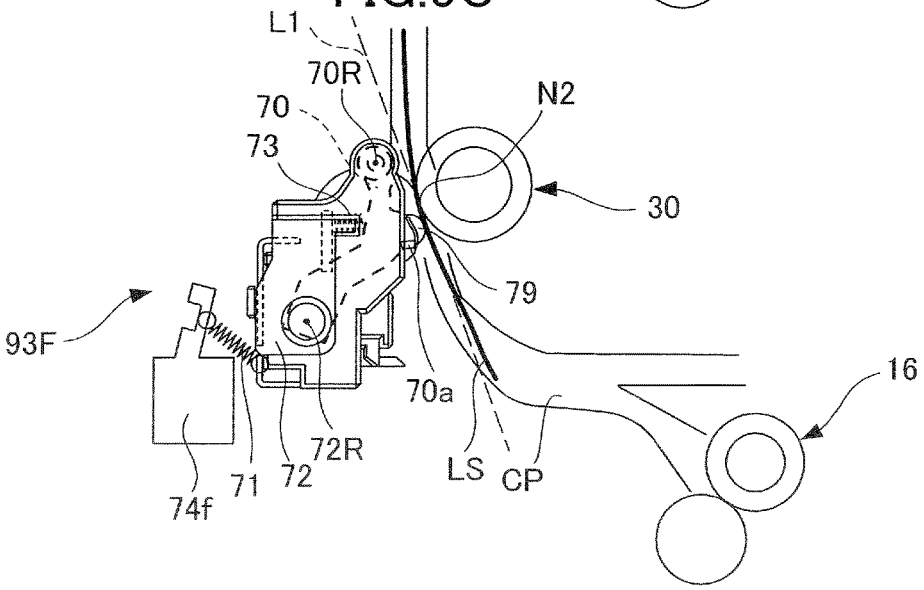
FIG. 5C is a side view illustrating a state in which a driven roller of the skew correction unit in a third state is sliding against a surface of the sheet.

In a state where the leading edge of the adhesive label sheet LS passes the abutment surface 70*a* and the driven roller 79, as illustrated in FIG. 5C, the retention member 72 returns to the first position by the urging force of the second urging spring 71 and the shutter member 70 pivots to the retreated position around the pivot shaft 70R serving as a first pivot shaft. By having the driven roller 79 pushed by the surface of the adhesive label sheet LS, the shutter member 70 pivots from the standby position to the retreated position against the urging force of the first urging spring 73. Thereby, the skew correction unit 93F will be in a third state where the retention member 72 is positioned at the first position and the shutter member 70 is positioned at the retreated position, and the driven roller 79 slides against the surface of the adhesive label sheet LS. In this state, the abutment surface 70*a* is positioned upstream in the sheet conveyance direction of the nip N2 of the registration roller pair 30.

In a state where the skew correction unit 93F is in the third state, the first flag 70*f* of the shutter member 70 blocks the optical axis of the photosensor 75, and the photosensor 75 detects that the adhesive label sheet LS is being conveyed. The driven roller 79 slides against the adhesive label sheet LS conveyed by the registration roller pair 30 and rotates by friction. The driven roller 79 is composed of a resin material containing fluorine, which suppresses adhesion of the adhesive on the adhesive label sheet LS on the driven roller 79.

When the driven roller 79 slides against the surface of the adhesive label sheet LS, the driven roller 79 is arranged further toward the conveyance path CP than the shutter member 70, so that the shutter member 70 is separated from the adhesive label sheet LS. In other words, the shutter member 70 is positioned so as not to intersect with a nip line L1 of the nip N2 of the registration roller pair 30. At this moment, the leading edge of the adhesive label sheet LS has already passed the abutment surface 70*a*. Therefore, even if an adhesive is adhered to the abutment surface 70*a* or other portions of the shutter member 70, adhesion of the adhesive label sheet LS to the adhesive can be suppressed. Thereby, it becomes possible to prevent the adhesive label sheet LS from adhering to the shutter member 70 or the retention member 72 and causing the shutter member 70 or the retention member 72 to move integrally with the adhesive label sheet LS, so that the positions of the shutter member 70 and the retention member 72 can be stabilized. Therefore, the operations of the first flag 70*f* and the second flag 72*f* that are respectively arranged on the shutter member 70 and the retention member 72 are stabilized, and the position of the adhesive label sheet LS can be detected accurately by the photosensor 75 while preventing erroneous detection.

Moreover, conveyance failure such as jamming caused by the adhesive label sheet LS being adhered to the shutter member 70 or the retention member 72 or damaging of the adhesive label sheet LS can be reduced. Further, since the leading edge of the adhesive label sheet LS is transferred smoothly from the abutment surface 70*a* to the driven roller 79, the peeling of the adhesive release paper of the adhesive label sheet LS caused by the adhesive being attached to the abutment surface 70*a* can be suppressed, and a high quality printing can be achieved.

When the trailing edge of the adhesive label sheet LS passes the driven roller 79, the shutter member 70 returns to the standby position by the urging force of the first urging spring 73, and the skew correction unit 93F returns to the first state. In a state where the skew correction unit 93F is returned to the first state, the first flag 70*f* and the second flag 72*f* open the optical axis of the photosensor 75, and the photosensor 75 detects that the adhesive label sheet LS has passed the sheet conveyance apparatus 7.

Second Embodiment

Next, a second embodiment of the present invention is illustrated, wherein the second embodiment has configured the skew correction unit 93F of the first embodiment with a simpler configuration. Therefore, configurations similar to the first embodiment are either not shown or denoted with the same reference numbers.

Configuration of Skew Correction Unit

Figure 6A:
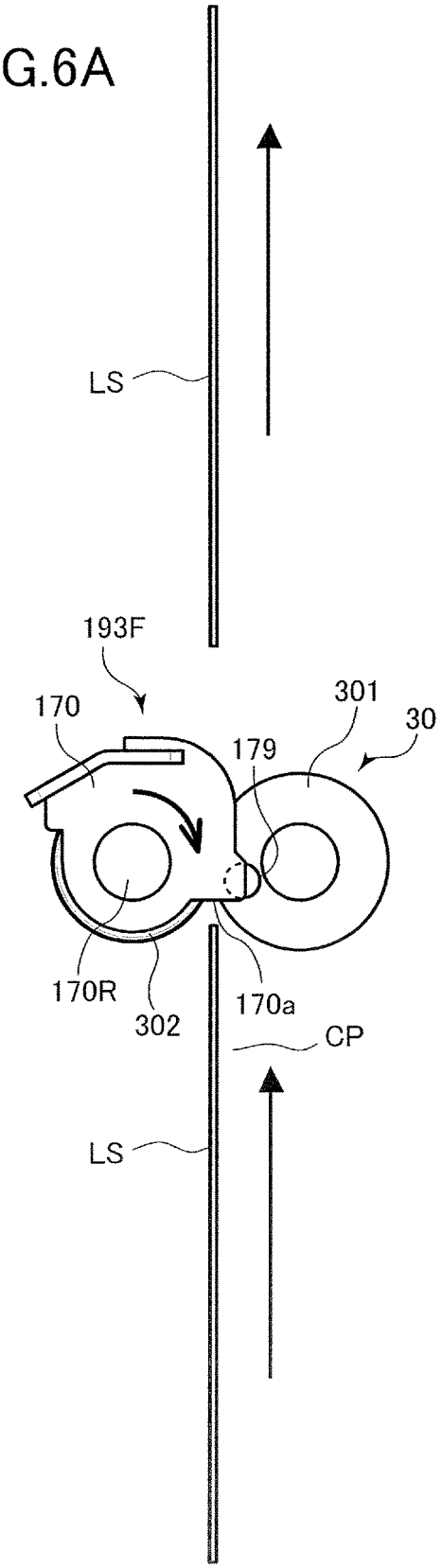
FIG. 6A is a side view illustrating a skew correction unit according to a second embodiment.

As illustrated in FIG. 6A, the skew correction unit 193F according to the present embodiment includes a shutter member 170, and a driven roller 179 supported rotatably on the shutter member 170. The shutter member 170 includes an abutment surface 170*a* against which a leading edge of the adhesive label sheet LS abuts, and is supported pivotably between a standby position (refer to FIG. 6A) and a retreated position (refer to FIG. 6B) around a pivot shaft 170R. The pivot shaft 170R is arranged coaxially with a center of rotation of the driven roller 302, but it can also be arranged coaxially with a center of rotation of the drive roller 301.

Further, the shutter member 170 is urged toward the standby position by a spring not shown. The shutter member 170 is provided with a flag not shown, similar to the first embodiment, and a photosensor not shown has an optical path that is opened or blocked by the flag.

The driven roller 179 is arranged downstream in the sheet conveyance direction than the abutment surface 170*a* of the shutter member 170 positioned at the standby position, and at least a portion of the outer circumference surface is protruded to a second side toward the conveyance path CP than the abutment surface 170*a* (right side in the drawing). Further, the driven roller 179 is composed of a resin material containing fluorine, which suppresses adhesion of the adhesive on the adhesive label sheet LS on the driven roller 179.

Operation of Skew Correction Unit

Next, the operation of the skew correction unit 193F in a state where the adhesive label sheet LS is conveyed will be described. As illustrated in FIG. 6A, in a state where the shutter member 170 is positioned at the standby position, the abutment surface 170*a* protrudes to the conveyance path CP. In a state where the leading edge of the adhesive label sheet LS abuts against the abutment surface 170*a*, a loop is formed to the adhesive label sheet LS, and skewing of the adhesive label sheet LS is corrected.

Figure 6B:
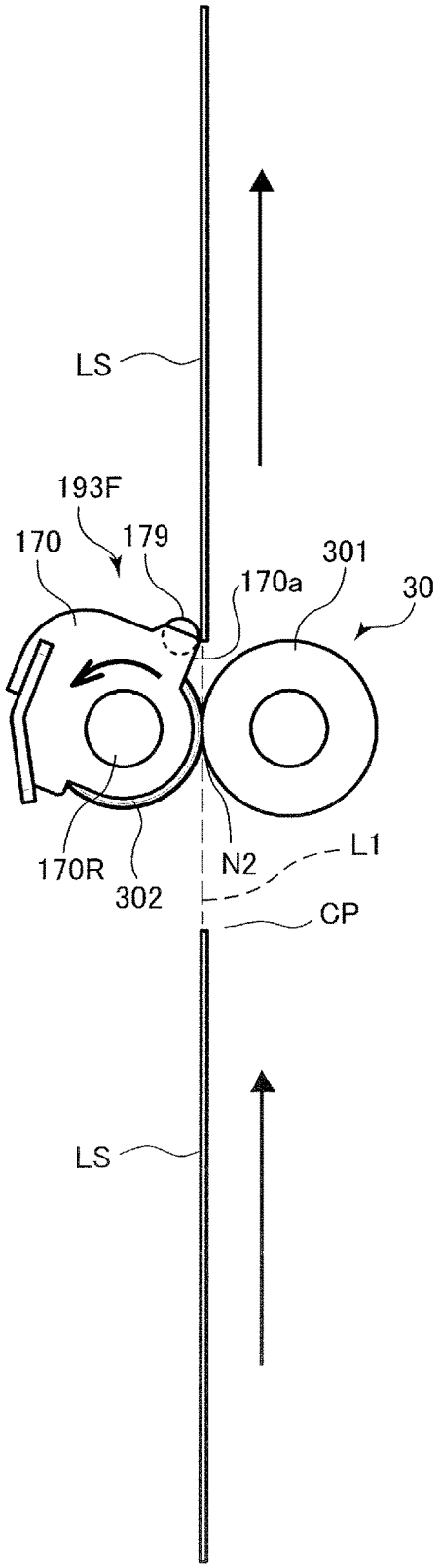
FIG. 6B is a side view illustrating a state where a shutter member is positioned at a retreated position.

Further, in a state where the adhesive label sheet LS is conveyed, as illustrated in FIG. 6B, the adhesive label sheet LS pivots the shutter member 170 around the pivot shaft 170R to the retreated position against the urging force of the spring. Thereby, the abutment surface 170*a* retreats from the conveyance path CP, and the nip N2 of the registration roller pair 30 nips and conveys the adhesive label sheet LS. In this state, the leading edge of the adhesive label sheet LS moves while sliding against the driven roller 179 from the abutment surface 170*a*.

Until the trailing edge of the adhesive label sheet LS passes the driven roller 179, the shutter member 170 is retained at the retreated position. In a case where the shutter member 170 is positioned at the retreated position, the driven roller 179 slides against the surface of the adhesive label sheet LS, and the shutter member 170 is separated from the adhesive label sheet LS. In other words, the shutter member 170 is positioned so as not to intersect with the nip line L1 of the nip N2 of the registration roller pair 30. Therefore, even if the adhesive is adhered to the abutment surface 170*a* or other portions of the shutter member 170, the adhesive label sheet LS is suppressed from being adhered to the adhesive.

Thereby, it becomes possible to prevent the adhesive label sheet LS from being adhered to and co-rotating with the shutter member 170, and to stabilize the position of the shutter member 170. Thus, the operation of the flag not shown provided on the shutter member 170 can be stabilized, and the position of the adhesive label sheet LS can be detected highly accurately while preventing erroneous detection by the photosensor.

Moreover, conveyance failure such as jamming caused by the adhesive label sheet LS being adhered to the shutter member 170 or damaging of the adhesive label sheet LS thereby can be reduced. Further, since the leading edge of the adhesive label sheet LS is transferred smoothly from the abutment surface 170*a* to the driven roller 179, the peeling of the adhesive release paper of the adhesive label sheet LS caused by the adhesive attached to the abutment surface 170*a* can be suppressed, and a high quality print can be obtained.

In all the embodiments described earlier, the skew correction units 93F and 193F were equipped with a function to correct skewing of the sheet and detect the position of the sheet, but the present invention is not limited to this example, and the configuration may only have one of these two functions. The position of the sheet may be detected by a switch or other sensors, instead of the photosensor 75.

The driven rollers 79 and 179 are formed of a resin material containing fluorine, but the present invention is not limited thereto, and the driven rollers 79 and 179 can be formed of any material. Further, a plurality of driven rollers can be provided on a single shutter member. Even further, if a plurality of skew correction units are provided, the driven roller may be provided on skew correction units excluding the skew correction units arranged at outermost sides in the width direction.

The embodiments described above have been illustrated based on the printer 1 adopting an electrophotographic system, but the present invention is not limited thereto. For example, the present invention can be applied to an image forming apparatus adopting an inkjet system in which an image is formed on a sheet by discharging ink through a nozzle.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-021749, filed Feb. 8, 2019, which is hereby incorporated by reference herein in its entirety.

What is claimed is:

1. A sheet conveyance apparatus comprising:

a first conveyance portion configured to convey a sheet in a sheet conveyance direction;

a first abutment member comprising a first abutment surface against which a leading edge, in the sheet conveyance direction, of the sheet conveyed by the first conveyance portion abuts, the first abutment member being configured to move from a standby position by being pressed by the leading edge of the sheet;

a second conveyance portion configured to nip and convey the sheet conveyed by the first conveyance portion;

a first urging member configured to urge the first abutment member toward the first standby position;

a first rotary member supported rotatably on the first abutment member, a second abutment member comprising a second abutment surface against which the leading edge of the sheet conveyed by the first conveyance portion abuts, the second abutment member being disposed in a position which is different from the first abutment member in a width direction orthogonal to the sheet conveyance direction, and being configured to move from a second standby position by being pressed by the leading edge of the sheet;

a second urging member configured to urge the second abutment member toward the second standby position; and a second rotary member supported rotatably on the second abutment member, the second rotary member being disposed in a position which is different from the first rotary member in the width direction, wherein the first abutment surface and the second abutment surface contact with the leading edge of the sheet conveyed by the first conveyance portion before the sheet is nipped by the second conveyance portion, wherein the second conveyance portion nips the sheet while the first abutment member and the second abutment member are moving from the first standby position and the second standby position respectively together with the first rotary member and the second rotary member by being pressed by the leading edge of the sheet, wherein the first rotary member and the second rotary member are in contact with the sheet being conveyed by the second conveyance portion after the leading edge of the sheet passes through the first abutment surface, the first rotary member, and the second abutment surface, and the second rotary member, and wherein the first abutment member and the second abutment member move toward the first standby position and the second standby position by the first urging member and the second urging member respectively after a trailing edge, in the sheet conveyance direction, of the sheet passing through the first rotary member and the second rotary member.

2. The sheet conveyance apparatus according to claim 1, wherein the first abutment member and the second abutment member are provided on a first side with respect to a conveyance path through which the sheet being conveyed by the first conveyance portion is guided, and at least each of a portion of an outer circumference surface of the first rotary member and a portion of an outer circumference surface of the second rotary member is protruded to a second side with respect to the conveyance path than the first abutment surface and the second abutment surface in a state where the first abutment member and the second abutment surface are positioned at the first standby position and the second standby position.

3. The sheet conveyance apparatus according to claim 1, further comprising:

a retention member configured to move between a first position and a second position that differs from the first position, the retention member being configured to support the first abutment member relatively movably between the first standby position and a first retreated position and supporting the second abutment member relatively movably between the second standby position and a second retreated position, the first rotary member and the second rotary member being in contact with the sheet being conveyed by the second conveyance portion in a case where the first abutment member and the second abutment member are respectively positioned at the first retreated position and the second retreated position; and a third urging member configured to urge the retention member from the second position toward the first position, wherein the first abutment member, the second abutment member and the retention member are configured to transit among a first state in which the retention member is positioned at the first position and the first abutment member and the second abutment member are respectively positioned at the first standby position and the second standby position, and in which the leading edge of the sheet conveyed by the first conveyance portion abuts against the first abutment surface and the second abutment surface, a second state in which the retention member is positioned at the second position and the first abutment member and the second abutment member are respectively positioned at the first standby position and the second standby position, and in which the leading edge of the sheet is separated from the first abutment surface and the second abutment surface, and a third state in which the retention member is positioned at the first position and the first abutment member and the second abutment member are respectively positioned at the first retreated position and the second retreated position, and in which the first rotary member and the second rotary member contacts a surface of the sheet.

4. The sheet conveyance apparatus according to claim 3, wherein the second conveyance portion is a roller pair, and the first abutment surface and the second abutment surface are respectively positioned upstream of a nip of the roller pair in the sheet conveyance direction in a state where the first rotary member and the second rotary member are in contact with the sheet being conveyed by the second conveyance portion.

5. The sheet conveyance apparatus according to claim 3, wherein the first abutment member is configured to pivot around a first pivot shaft, wherein the second abutment member is configured to pivot around a second pivot shaft coaxially located with the first pivot shaft, and the retention member is configured to pivot around a third pivot shaft that differs from the first pivot shaft and the second pivot shaft.

6. The sheet conveyance apparatus according to claim 3, wherein the first rotary member and the second rotary member are respectively arranged downstream of the first abutment surface and the second abutment surface in the sheet conveyance direction in a state where the first abutment member, the second abutment member and the retention member are at the first state.

7. The sheet conveyance apparatus according to claim 3, further comprising:

a third abutment member comprising a third abutment surface against which the leading edge of the sheet conveyed by the first conveyance portion abuts, the third abutment member being supported by the retention member, being disposed between the first abutment member and the second abutment member in the width direction, and being configured to move from a third standby position by being pressed by the leading edge of the sheet;

a first flag provided on the third abutment member;

a second flag provided on the retention member; and a photosensor whose optical path is configured to be blocked by the first flag and the second flag.

8. The sheet conveyance apparatus according to claim 7, wherein there is no rotary member, capable of contacting with the sheet being conveyed by the second conveyance portion, supported rotatably on the third abutment member.

9. The sheet conveyance apparatus according to claim 1, wherein the second conveyance portion comprises a first roller, and a second roller configured to nip and convey the sheet with the first roller, and the first abutment member and the second abutment member are configured to pivot around a center of rotation of the second roller.

10. The sheet conveyance apparatus according to claim 1, wherein each of the first rotary member and the second rotary member is composed of a resin material containing fluorine.

11. The sheet conveyance apparatus according to claim 1, wherein the first abutment member and the second abutment member are configured to correct skewing of the sheet by forming a loop on the sheet by having the leading edge of the sheet abut against the first abutment surface and the second abutment surface.

12. An image forming apparatus comprising:

the sheet conveyance apparatus according to claim 1; and an image forming unit configured to form an image on a sheet.

13. The sheet conveyance apparatus according to claim 1, wherein the second conveyance portion is a roller pair forming a nip configured to nip and convey the sheet, and wherein the first abutment member and the second abutment member are respectively positioned at positions where the first abutment member and the second abutment member do not intersect with a nip line of the roller pair in a state where the first rotary member and the second rotary member are in contact with the sheet being conveyed by the roller pair after the leading edge of the sheet being conveyed passes the first abutment surface, the first rotary member, the second abutment surface, and the second rotary member.

14. The sheet conveyance apparatus according to claim 1, wherein the second abutment surface is disposed at the same position as the first abutment surface in the sheet conveyance direction in a case where the first abutment member and the second abutment member are respectively positioned at the first standby position and the second standby position.

15. The sheet conveyance apparatus according to claim 1, further comprising a third abutment member comprising a third abutment surface against which the leading edge of the sheet conveyed by the first conveyance portion abuts, the third abutment member being disposed between the first abutment member and the second abutment member in the width direction, and being configured to move from a third standby position by being pressed by the leading edge of the sheet, wherein there is no rotary member, capable of contacting with the sheet being conveyed by the second conveyance portion, supported rotatably on the third abutment member.

16. The sheet conveyance apparatus according to claim 15, wherein the third abutment surface is disposed downstream of the first abutment surface and the second abutment surface in the sheet conveyance direction in a case where the first abutment member, the second abutment member and the third abutment member are respectively positioned at the first standby position, the second standby position and the third standby position.

17. The sheet conveyance apparatus according to claim 15, further comprising:

a flag provided on the third abutment member; and a detection sensor configured to detect a position of the sheet based on a position of the flag.

* * * * *